United States Patent [19]

Blanchard et al.

[11] Patent Number: 4,582,653

[45] Date of Patent: Apr. 15, 1986

[54] DOUBLE COIL THROTTLE RETURN SPRING

[75] Inventors: Terry L. Blanchard; Albert L. Haas, both of Cass City, Mich.

[73] Assignee: Walbro Corporation, Cass City, Mich.

[21] Appl. No.: 706,847

[22] Filed: Feb. 28, 1985

[51] Int. Cl.[4] ..... F02M 19/12

[52] U.S. Cl. ..... 261/65; 74/513; 123/198 D; 267/58; 267/155

[58] Field of Search ..... 261/65; 267/58, 155, 267/170; 123/198 D; 74/513

[56] References Cited

U.S. PATENT DOCUMENTS

| | | | |
|---|---|---|---|
| 2,459,012 | 1/1949 | Barth | 267/155 |
| 2,973,908 | 3/1961 | Danyluke | 267/58 |
| 3,927,657 | 12/1975 | Mennesson | 123/198 D |
| 3,943,907 | 3/1976 | Kluth | 123/198 D |
| 4,285,676 | 8/1981 | Kraft | 267/155 |

FOREIGN PATENT DOCUMENTS

| | | | |
|---|---|---|---|
| 484374 | 9/1953 | Italy | 267/58 |

*Primary Examiner*—Tim Miles

*Attorney, Agent, or Firm*—Barnes, Kisselle, Raisch, Choate, Whittemore & Hulbert

[57] ABSTRACT

A double coil spring assembly to serve as a closing force for throttle valves of carburetors or throttle bodies, the spring assembly including an integral spool with inner and outer arbors supported on a closed end to separately support inner and outer coil springs, there being lands on the outer arbor to position axially the outer spring, and the inner spring as an installable component in the assembly of the carburetor or throttle body.

2 Claims, 10 Drawing Figures

DOUBLE COIL THROTTLE RETURN SPRING

FIELD OF INVENTION

Automotive internal combustion carburetors or throttle bodies which have a throttle valve with a return spring to return the valve to closed position when a hand or foot lever is released.

BACKGROUND AND FEATURES OF THE INVENTION

Automotive carburetors or throttle bodies usually have a throttle valve which is manually (by hand or by foot) actuated to control the speed of an engine. This throttle valve controls either the air and fuel mixture in a mixing passage of a carburetor or the air flow through a throttle body in fuel systems where the fuel is injected into a manifold or into individual cylinders.

In either case, it is a requirement that a double spring be utilized to bring the throttle valve to a closed position when the manual control is released or in the exceptional circumstance when a throttle control linkage becomes disconnected or fails for any reason. The reason for the double coil requirement lies in the desire to have at least one spring operating to close the throttle in the event the other spring fails for some reason.

It is an object of the present invention to provide a double coil spring assembly which meets the standards requirement.

It is a further object to provide a one-piece bushing assembly to carry both springs which is inexpensive to manufacture and which provides an assembly unit which can be handled as a single component and readily assembled to its final position on the throttle shaft which it is intended to control.

It is a further object to provide an assembly which occupies a minimum of space and in which the spring legs all anchor on a solid material other than the integral spool.

Other objects and features of the invention will be apparent in the following description and claims in which the invention is described, together with details to enable persons skilled in the art to practice the invention, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
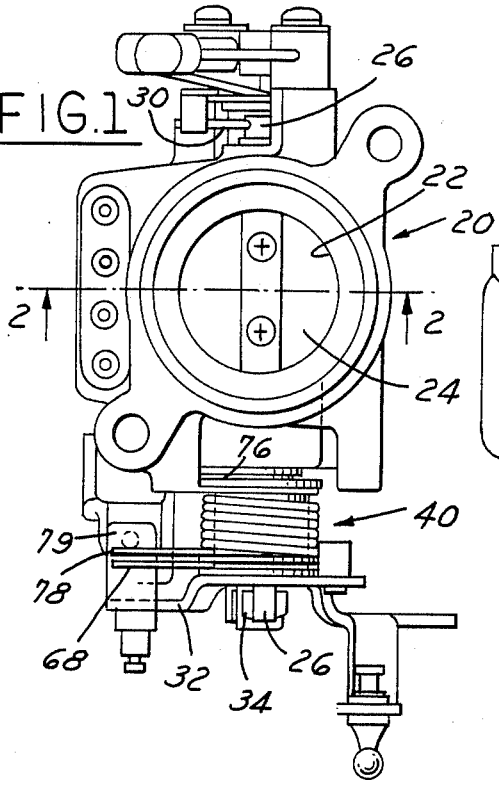
FIG. 1, a view of a throttle body on which the double coil spring is mounted.
Figure 2:
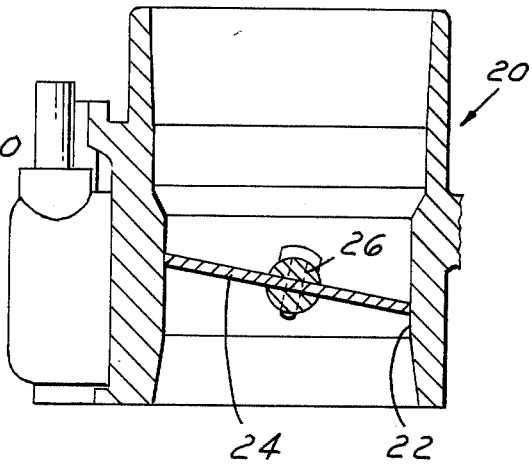
FIG. 2, a sectional view on line 2—2 of FIG. 1 illustrating the throttle valve.

With reference to the drawings, in FIG. 1, a throttle body 20 is illustrated with a venturi passage 22 controlled by a throttle valve plate 24 mounted on a control shaft 26. The control shaft 26 extends through the body 20 to each side. At one end of the control shaft (at the top of FIG. 1), a short lever 30 controls an electrical device which is unrelated to this disclosure. At the other end of the control shaft, a throttle valve control lever 32 is mounted and secured by a nut 34.

The throttle lever 32 will be controlled by a suitable linkage mechanism (not shown) to be operated by an accelerator pedal.

A double coil spring return assembly is mounted on the end of the control shaft 26 shown at the bottom of FIG. 1. This assembly is composed of a spool 40 formed of a strong plastic material and molded as one piece. As shown in FIGS. 5 to 10, the outer wall 41 of the spool 40 has another land or flange 42 at one end and two closely spaced lands 44, 46 at the other end. The outer wall 41 has a longitudinal opening 50, the purpose of which will be explained below.

The spool 40 has at one end a radial wall 52 as a continuation of the end land 46 and internally of this end wall and integral therewith is an inner hollow spool 60, which has a bore 62 to receive the control shaft 26.

Figure 5:
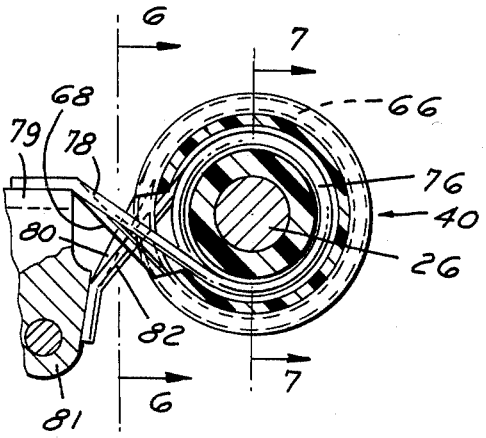
FIG. 5, a sectional view of a spring assembly taken on line 5—5 of FIG. 6.
Figure 6:
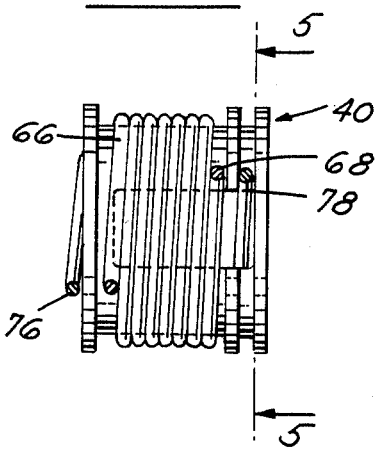
FIG. 6, a side view of the spring assembly taken on line 6—6 of FIG. 5.
Figure 8:
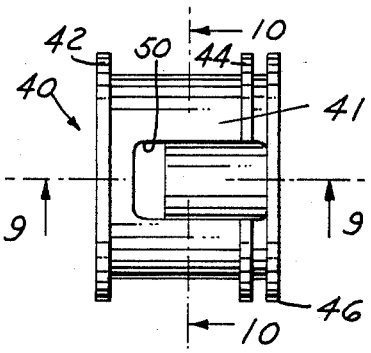
FIG. 8, an elevation of the spring mount spool without the springs.
Figure 9:
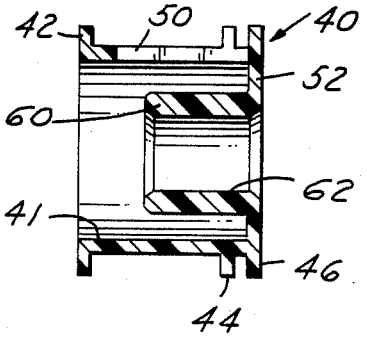
FIG. 9, a sectional view of the spring mount spool taken on line 9—9 of FIG. 8.
Figure 7:
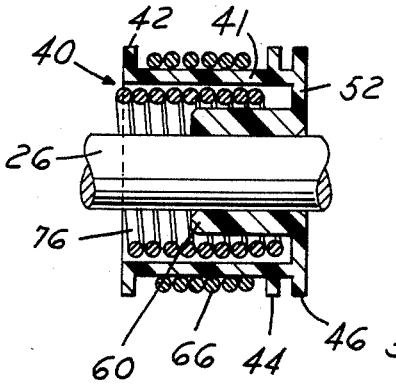
FIG. 7, a sectional view on line 7—7 of FIG. 5.
Figure 10:
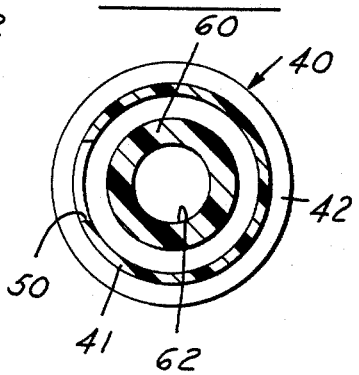
FIG. 10, a sectional view on line 10—10 of FIG. 8.

As illustrated in FIGS. 5, 6 and 7, two coil springs are mounted on the spool 40. An outer spring 66 is disposed around the outer wall 41 between lands 42 and 44. An inner coil 76 is mounted around the inner spool 60 inside the end wall 52. Each spring has, of course, two ends, one to locate on the throttle control lever and one to anchor on the throttle body 20.

In FIG. 5 can be viewed the ends of the spring which anchor on the control lever. Spring 66 has end 68 and spring 76 has end 78 which anchor on a lug extension 79 of the control lever 32. The end 78 on the inner spring 76 exits the outer spool wall through the opening 50 and is disposed in the groove between the spaced lands 44, 46. Thus, the inner spring is confined radially because of this disposition of the end 78.

Figure 3:
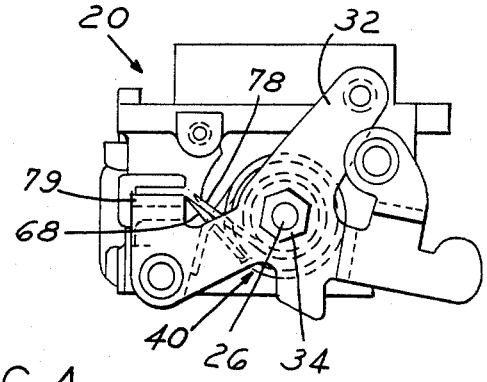
FIG. 3, a side view of the throttle body showing the operating lever.
Figure 4:
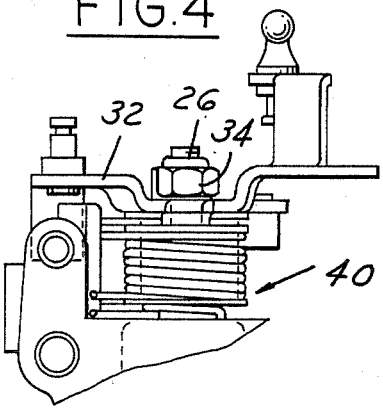
FIG. 4, a view of the double coil spring from the side opposite that shown in FIG. 1.

The other ends of the springs bear against a portion of the body 20 as shown in FIGS. 3, 4 and 5. The outer spring has an end 80 which anchors against a portion 81 of the body and the inner spring has an end 82 which anchors against the same body portion 81. The end 82 of the inner spring exits the spool at the end near the land 42.

The inner coil spring 76 projects to some degree from the spool 40 and presses against the body 20 in assembly to hold the spool assembly against the control lever.

It will be seen that the springs 66 and 76 may be installed on the spool and will be retained on the spool prior to installation on the throttle valve shaft. The lands 42, 44 retain the outer spring 66 and the groove between lands 44 and 46 retains the inner spring because the one end of the inner spring exits through opening 50 into this groove. Thus, the spool and springs may be assembled and shipped as a sub-assembly ready to be installed on the throttle shaft.

What is claimed is:

1. A housing having a throttle controlled passage for use in a fuel system for internal combustion, a throttle valve in said passage movable from a closed to an open position, and a throttle shaft having an operating lever extending through said housing movably mounting said throttle valve, an operating lever on said shaft, and a double coil spring assembly to provide a resilient return motion to said throttle shaft to a closed position of said throttle valve, said spring assembly comprising:

(a) an integral mounting spool having a central bore to receive said throttle shaft, an inner spring arbor adjacent said bore, and an outer spring arbor concentric with and spaced from said inner arbor, and an end wall common to said arbors, (b) spaced end lands on the outer spring arbor, one at each end of said arbor, and a third land spaced adjacent one of said end arbors, and a passage formed in said outer arbor, (c) an outer coil spring on said outer arbor having one end to contact said lever and another end to contact said housing, said outer coil spring being located between one of said end lands and said third land, and (d) an inner coil spring on said inner arbor having one end to contact said lever and another end to contact said housing, one of said ends projecting through said passage in said outer arbor to lie between said third land and the other of said end lands to retain said inner coil spring axially within said spool.

2. A double coil spring assembly for use in a carburetor or other mechanism where a resilient bias is necessary between relatively movable parts, said spring assembly comprising:

(a) an integral mounting spool having a central bore to receive said throttle shaft, an inner spring arbor adjacent said bore, and an outer spring arbor concentric with and spaced from said inner arbor, and an end wall common to said arbors, (b) spaced end lands on the outer spring arbor, one at each end of said arbor, and a third land spaced adjacent one of said end arbors, and a passage formed in said outer arbor leading from said inner arbor to the space between said lands, (c) an outer coil spring on said outer arbor having projecting ends at each end of said outer coil to anchor respectively on relatively movable parts, said outer coil being located between one of said end lands and said third land, and (d) an inner coil spring on said inner arbor having projecting ends at each end of said inner coil to anchor respectively on said relatively movable parts, one of said ends projecting through said passage in said outer land to lie between said third land and the other of said end lands to retain said inner coil axially within said spool on said inner land.

* * * * *